US005360641A

United States Patent [19]

Tu

[11] Patent Number: 5,360,641

[45] Date of Patent: Nov. 1, 1994

[54] STRIPPING LIQUID COATINGS

[75] Inventor: Cat V. Tu, Corrimal East, Australia

[73] Assignee: John Lysaght (Australia) Limited, Sydney, Australia

[21] Appl. No.: 42,495

[22] Filed: Apr. 2, 1993

[30] Foreign Application Priority Data

Apr. 6, 1992 [AU] Australia ..... PL1739

[51] Int. Cl.[5] ..... B05D 3/04

[52] U.S. Cl. ..... 427/348; 427/349; 427/430.1; 118/63; 118/66; 118/67

[58] Field of Search ..... 427/348, 349, 430.1; 118/63, 66, 67

[56] References Cited

U.S. PATENT DOCUMENTS 3,607,366 11/1968 Kurokawa .
4,502,408 3/1985 Hennechart et al. ..... 118/61

FOREIGN PATENT DOCUMENTS

69901/81 11/1981 Australia .
54-08124 1/1979 Japan .
55-128570 10/1980 Japan .
62-40350 2/1987 Japan .

*Primary Examiner*—Shrive Beck
*Assistant Examiner*—David M. Maiorana
*Attorney, Agent, or Firm*—Nikaido, Marmelstein, Murray & Oram

[57] ABSTRACT

A jet stripping apparatus comprises a stripping nozzle positioned to direct a stripping gas jet stream (11) against each side of a steel strip (7) emerging from a bath (8) of molten zinc or aluminium/zinc alloy with a layer (9) of bath material thereon, means to supply gas to said stripping nozzle at a pressure sufficient to liberate a relatively strong stripping jet stream (11) therefrom, and surface modifying means spaced closely below said stripping nozzle effective to smooth the surface of said layer (9) prior to it reaching the stripping jet stream (11). Said surface modifying means preferably comprise a smoothing nozzle positioned to direct a relatively weak surface modifying gas jet stream (18) against the layer (9) that is effective to smooth the layer but not to substantially affect the quantity of material passing it.

9 Claims, 1 Drawing Sheet

STRIPPING LIQUID COATINGS

BACKGROUND OF THE INVENTION

1. Field of the Invention

The present invention relates to apparatus of the kind used to remove excess liquid coating from a moving strip emerging from a coating bath and which operate by directing jet streams of pressurised gas onto the coated surfaces of the strip.

The invention was developed to control the thickness of the zinc or aluminium/zinc alloy coating applied to steel strip in a continuous hot dip galvanising plant, and is described primarily in that context hereinafter. It will be understood, however, that the apparatus of the invention is equally applicable to the control of liquid coatings generally on any moving strip substrate.

2. Description of the Prior Art

In a typical continuous strip hot dip galvanising process, a strip of steel to be coated, after preliminary treatment, passes downwardly into a bath of molten zinc or zinc/aluminium alloy, around a sink roll submerged in the bath, upwardly past at least one deflector roll located just below the surface of the bath, through jet stripping apparatus located closely above the bath, and to and about a turn-around roll located well above the bath.

Traditionally, the jet stripping apparatus has comprised elongate nozzles, one on each side of the strip, extending transversely of the strip and each directing a substantially planar jet stream of gas against the vertical strip. The gas stream acts as a barrier preventing the passage of the outermost layers of the coating material, but allowing a thin, still liquid, inner layer to advance with the strip.

The turn-around roll is the first solid object to contact the coated strip, and it is necessary for the coating to have solidified before contact is made. Having regard to the speed of operation of modern plants, the turn-around roll is, therefore, a considerable distance above the bath, even though strip coolers may be provided to ensure that the coating solidifies before it reaches the roll.

Because of its length, the unsupported strip between the bath and the turn-around roll tends to vibrate. The vibrations cause variations in the distances between the strip and the respective stripping nozzles, and this results in objectionable variations in the coating thickness.

To overcome that disability it has been proposed to provide a gas pressure stabilising pad, sometimes referred to as a floater pad, on each side of the strip above the stripping nozzles. Each such pad comprises a reaction body adjacent to, but spaced from, the strip, and nozzles directing pressurised gas into the space between the strip and the body. Thus, a gas pressure is built up within the space having a value which depends inversely on the leakage from that space, which, in turn, depends on the distance between the body and the strip. The pads are in register, and their net effect is to provide a restoring force whenever the strip wanders from a stable position which, assuming identical pads and gas supplies, is midway between the pads. Floater pads of that kind are described in the complete specification of Australian patent 529545 in the name of Nippon Steel Corporation.

It is also known to combine a floater pad and a gas stripping apparatus into a single unit having two nozzles, both of which contribute gas to the pressurised space between the body of the pad and the strip, and one of which also provides the stripping jet stream. Typically, such a dual-nozzle assembly comprises upper and lower, parallel nozzles, spaced apart by a reaction body. Dual nozzle floater pad/stripping assemblies of that kind are described in the complete specifications of Australian patents Nos. 581081 and 630281 in the name of the present applicant.

If a traditional isolated or stand alone stripping nozzle is used, the stripping jet stream divides, on impingement with the strip, into upwardly flowing and downwardly flowing component streams. It has been found that the upwardly flowing component stream may produce ripples in the surface of the still liquid coating material on the strip above the line of impingement. Thus it has also been proposed to provide a compensating nozzle disposed some distance above each stripping nozzle and liberating a downwardly directed gas stream. That downwardly directed stream annuls or overwhelms the upward flowing component of the stripping jet stream and prevents the formation of the aforesaid ripples. Such a compensating nozzle and its effect are described in the specification of U.S. Pat. No. 3,607,366 in the name of Yawata Iron & Steel Co. Ltd.

In all prior known arrangements as discussed above, the stripping of each side of the strip, that is to say the prevention of the passage of more coating material than that required in the finished product, has been effected by a single gas jet stream, being the stream first met by the strip as it rises from the bath. In dual nozzle stripping/floater pad assemblies the jet stream from the lower nozzle does the stripping and the upper jet stream does not alter the thickness of the liquid coating on which it plays. Likewise, when a compensating nozzle is present, its jet stream plays no part in the reduction of mean coating thickness. It is still the lower jet stream which does the stripping.

The liquid coating dragged up from the bath by the strip has its maximum thickness at the surface of the bath. As it rises further from the bath it is accelerated by viscous drag from the strip, so that its mean upward speed asymptotically approaches that of the strip, which speed is fully attained on solidification, and its mean thickness correspondingly decreases. The stripping jet stream is necessarily positioned where the coating reaching it is still thicker than the required finished coating, and the gas pressure, nozzle outlet width and nominal nozzle spacing from the strip are chosen having regard to the strip speed so as to produce a residual coating layer of the required thickness (typically about 20 micrometers).

While all of the dragged up liquid may be rising with the strip, at least the outer layers move more slowly than the strip and the liquid immediately adjacent the strip. That is to say, relative to the strip and the liquid in direct frictional engagement with the strip, the outer layers of the dragged up liquid, including the liquid coating material which is held back by the stripping jet stream, are moving downwardly in the manner of a falling cascade flowing over a stationary surface. Thus, the coating material below the stripping jet stream takes on the typical appearance of such a cascade, with irregular ripple or wave formations extending generally horizontally across its surface.

It has been found that conventional gas stripping devices are unable to suppress those ripple or wave formations completely, with the result that the finished coating has undesirable surface irregularities and/or the coating has undesirable localised variations in thickness, due to the residual effect of those ripple or wave formations.

SUMMARY OF THE INVENTION

An object of the present invention is to substantially eliminate the aforesaid undesirable characteristics, and so provide a smoother and more uniform coating than has been attainable hitherto.

The invention achieves that object by providing surface modifying means closely below the line of impingement of the stripping jet. Those surface modifying means may comprise a doctor blade spaced from the strip to an extent such that it only affects the outermost layer of the coating material, but preferably comprise a smoothing nozzle playing a surface modifying, relatively weak jet stream upon the rising coating material. The surface modifying jet stream is too weak to substantially affect the amount of coating material ascending past it, but does serve to at least partially suppress the surface ripples or waves thereon. Thus a smoother liquid layer is presented to the stripping jet, with a consequent improvement in the smoothness and uniformity of the layer departing from it.

Therefore, the invention consists in a jet stripping apparatus comprising a stripping nozzle positioned to direct a stripping gas jet stream against one side of a strip emerging from a coating bath with a layer of bath material thereon, means to supply gas to said stripping nozzle at a pressure sufficient to liberate an effective stripping jet stream therefrom, and surface modifying means spaced closely below said stripping nozzle effective to smooth the surface of said layer prior to it reaching the stripping jet stream.

The invention further consists in a method of continuously coating a strip, comprising the steps of passing the strip through a bath of liquid coating material, smoothing the surface of the material on the strip dragged by it from the bath, and directly thereafter stripping surplus material from the strip.

BRIEF DESCRIPTION OF THE DRAWINGS

By way of example, an embodiment of the above described invention is described in more detail hereinafter with reference to the accompanying drawings.

In the drawings corresponding items bear corresponding reference numerals.

DESCRIPTION OF PREFERRED EMBODIMENTS

Figure 1:
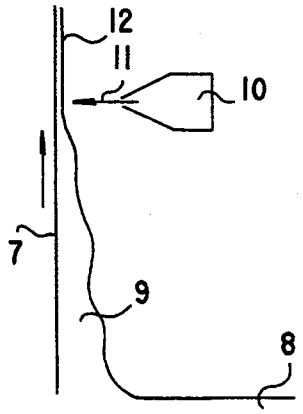
FIG.1 PRIOR ART
FIGS. 1 and 2 are diagrammatic, not to scale, cross-sectional views of conventional gas stripping apparatus.

FIG. 1 shows a traditional arrangement wherein a strip 7 rises from a bath 8 of molten metal coating material and drags a layer 9 of coating material with it. The strip 7 travels past a stripping nozzle 10 which directs a stripping gas jet stream 11 towards the strip 7. Below the stripping jet stream 11 the surface of the layer 9 shows unstable wave formations and the layer itself, although progressively decreasing in mean thickness, is thicker than the relatively constant thickness and thinner coating layer 12 to which the layer 9 is reduced by the action of the stripping jet stream 11.

The coating layer 12 may only be said to be of "relatively constant thickness" because the jet stream 11 is unable completely to eliminate or prevent the presence of the surface waves, so that residual irregularities remain in the coating layer 12 as it departs from the stripping jet stream 11.

This effect is particularly marked at slow strip speeds as the jet stream 11 is then necessarily reduced in strength, either because the gas pressure to the nozzle 10 is reduced or because the width of its outlet slot is reduced or both, by comparison with the values pertaining at high speed operation. This is to ensure that the finished coating is of adequate thickness. The invention overcomes this effect and thus is particularly beneficial when applied to low speed production lines.

In all the figures hereof, only the situation to the right of the strip 7 is shown. In actuality coating operation material is dragged up on both sides of the strip 7 and that on the left hand side is stripped by a complementary stripping nozzle aligned with and opposing nozzle 10. The full diagram would include a left hand half which, except for the irregularity of the instability in the surface of the layers of coating material below the nozzles, would in general be a mirror image of the right hand half constituting the figure as shown. This applies to all of the figures herewith.

Figure 2:
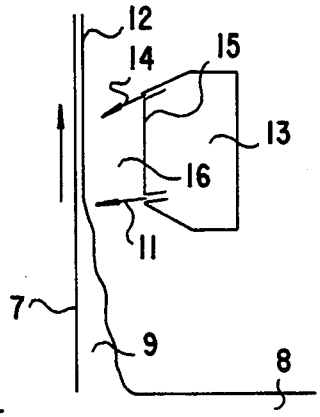
FIG.2 PRIOR ART

FIG. 2 illustrates another instance of prior art. The stripping is effected by the lower jet stream 11 emanating from a dual nozzle stripping/floater pad combination 13. The upper jet stream 14 merely cooperates with the stripping jet stream 11 to maintain a stabilising gas pressure in the space 16 between the reaction surface 15 of the stripping/floater pad combination and the strip 7. It has no substantial effect on the thickness of the reduced coating layer 12.

Figure 3:
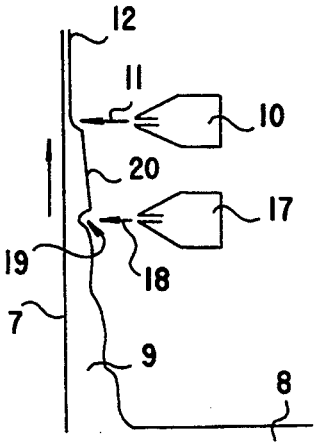
FIG. 3 is a schematic side elevation of one embodiment of this invention.

FIG. 3 shows an arrangement the same as that of FIG. 1 except for the addition, in accordance with the invention, of surface modifying means comprising, in this instance, a smoothing nozzle 17 spaced slightly below the stripping nozzle 10. The smoothing nozzle 17 directs a surface modifying jet stream 18 onto the coating material 9.

The jet stream 18 is not strong enough to prevent the upward movement of substantial amounts of coating material. It only affects the outer layers of the material and produces a standing, substantially linear trough 19 in the surface coating. This serves to replace the unstable and variable wave pattern below the jet stream 18 with a constant or steady condition and results in a substantially smooth surface 20 on the layer of coating material proceeding to the stripping jet stream 11. This in turn produces a more regular and smoother coating layer 12 than would otherwise be.

According to this embodiment of the invention as applied, for example, to a typical aluminium/zinc alloy coating process run at a strip speed of 25 meters per minute, the surface modifying jet stream 18 may issue from a nozzle in the order of a millimeter wide or narrower, say 0.4 ram, spaced about 10 mm from the strip and fed with gas at a pressure in the range of 2–10 kPa, preferably about 4.0 kPa. This may be contrasted with typical stripping jet stream parameters, as found in prior art devices (such as, for example, those of the Yawata Iron and Steel patent referred to above), namely, for the lowest practicable strip speed of say 10 meters minute, a nozzle at least 0.5 mm wide spaced ,, 3 mm from the strip and fed with gas at a pressure of at least 25 kPa and, for more usual strip speeds, say up to 60 meters minute, a nozzle 3 mm wide, spaced 5 mm from the strip and fed with gas at a pressure of 300 kPa.

The jet streams 11 and 18 are shown as normal to the strip 7. This is frequently the case, but it will be known to those skilled in the art that this is not essential and in other embodiments the several jet streams may be inclined downwardly or upwardly at angles up to about 45° to the horizontal. This applies to all of the illustrated embodiments.

Figure 4:
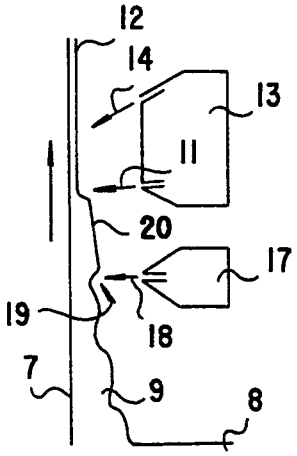
FIG. 4 is a schematic side elevation of one embodiment of this invention.

FIG. 4 shows an arrangement in which the stripping is effected by a stripping/floater pad assembly 13 as in FIG. 2, and the prior smoothing is effected by a smoothing nozzle 17 similar to and operating in the same way as the corresponding nozzle 17 in FIG. 3.

Figure 5:
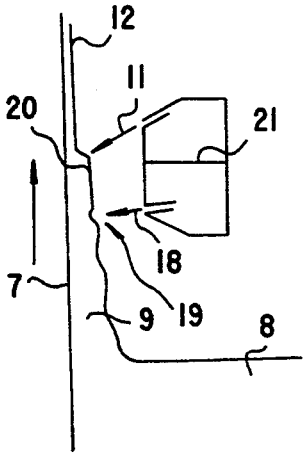
FIG. 5 is a schematic side elevation of one embodiment of this invention.

FIG. 5 shows how a substantially conventional stripping/floater pad assembly may be used to effect the method of the invention by adjusting the relative strengths of the jet streams so as to shift the stripping function to a strong upper jet stream 11 and smoothing with a weak jet stream 18. In the drawing the plenum chamber feeding the respective nozzles is shown with a dividing wall 21, enabling the strength adjustment to be effected by feeding each jet from separately controllable gas supplies. In other embodiments the required strength relationship can be achieved using a common gas source by varying the respective nozzle's outlet widths and spacings from the strip.

Figure 6:
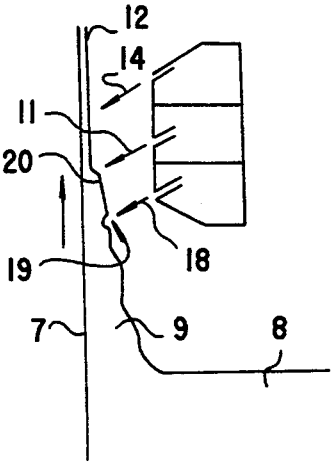
FIG. 6 is a schematic side elevation of one of the embodiments of the invention.

FIG. 6 shows another possibility wherein the surface modifying means are united with a stripping/floater pad assembly. The plenum chamber is shown divided to enable jet strengths to be adjusted by control of their respective supply pressures, but once again, if preferred, this may be achieved by choice of nozzle widths and spacings from the strip.

In all instances in apparatus according to the invention utilising surface modifying means comprising a nozzle releasing a smoothing jet stream, the stripping jet stream which is located above the smoothing jet stream may issue from a nozzle having an outlet width that is smaller, equal to or greater than that of the nozzle of the smoothing jet stream, provided that the stripping jet stream has the stronger effect. As an example, all else being equal, a smoothing nozzle having a width of 0.4 mm may be used in conjunction with a stripping nozzle of width 0.8 min. If the stripping nozzle is narrower than the smoothing nozzle, then the other parameters (supply pressures, distance from strip, and angles of attack) must be selected to ensure that the stripping jet stream has the dominant effect in determining the final coating thickness.

I claim:

1. A jet stripping apparatus comprising a stripping nozzle positioned to direct a stripping gas jet stream against one side of a strip emerging from a coating bath with a layer of bath material thereon, means to supply gas to said stripping nozzle at a pressure sufficient to liberate an effective stripping jet stream therefrom, and surface modifying means spaced above said bath a distance sufficient such that surface irregularities have formed in said coating after said coated strip has emerged from said bath and below said stripping nozzle a distance which is effective to smooth the whole of the surface of said layer prior to it reaching the stripping jet stream.

2. Apparatus according to claim 1 wherein said surface modifying means comprise a smoothing nozzle positioned to direct a surface modifying gas jet stream against said one side of the strip and means to supply gas to said smoothing nozzle at a pressure sufficient to liberate a surface modifying jet stream therefrom; said surface modifying jet stream being effective to smooth the layer of bath material passing it but not to substantially affect the quantity of material passing it.

3. Apparatus according to claim 2 wherein said strip comprises steel and coating comprises aluminum/zinc alloy coating material, means for running said steel strip at a strip speed of about 25 meters per minute, means for issuing the surface modifying jet stream from a smoothing nozzle which is about 0.4 mm wide and is spaced about 10 mm from the strip, and means for feeding gas through said smoothing nozzle at a pressure in the range of from 2 to 10 kPa.

4. Apparatus according to claim 3 wherein said gas pressure is substantially 4.0 kPa.

5. Apparatus according to claim 2 wherein said stripping nozzle is an upper nozzle of a floater pad and said smoothing nozzle is a lower nozzle of said floater pad.

6. Apparatus according to claim 5 wherein said floater pad includes means for the independent control of the pressure of the gas supplied to each of its said nozzles.

7. Apparatus according to claim 2 wherein said smoothing nozzle is united with a stripping/floater pad assembly, comprising a compartmented plenum chamber wherein an upper compartment feeds a pressure control nozzle, an intermediate compartment feeds the stripping nozzle and a bottom compartment feeds the smoothing nozzle, and means to independently control the gas pressures in each compartment.

8. A method of continuously coating a strip comprising the steps of:

passing the strip through a bath of liquid coating material, dragging a layer of coating material out of said bath disposed on the surface of said strip;

allowing surface irregularities to form on the layer of coating material disposed on said strip, then smoothing out said irregularities on the surface of the layer of coating material on the strip dragged by it from the bath, and directly thereafter stripping surplus material from the strip.

9. A method according to claim 8 wherein said step of smoothing the surface comprises impinging a smoothing jet stream of gas on the coating material on each side of the emerging strip in an amount and at a pressure sufficient to smooth the layer of material thereon, and the step of stripping surplus material comprises thereafter impinging a stripping jet steam of gas on each side of the strip in an amount and at a pressure sufficient to reduce the thickness of the smoothed layer thereon to a final thickness; wherein said smoothing jet stream is weaker than said stripping jet stream.

* * * * *